United States Patent [19]

Dicke et al.

[11] Patent Number: 4,863,138

[45] Date of Patent: Sep. 5, 1989

[54] DEFLECTABLE MOUNTING FOR UPRIGHT MAST

[76] Inventors: Clarence C. Dicke, 4524 Seeley Ave.; Grant D. Dicke, 1130 Franklin St., both of Downers Grove, Ill. 60515

[21] Appl. No.: 594,879

[22] Filed: Mar. 29, 1984

[51] Int. Cl.[4] ..... F16M 13/00

[52] U.S. Cl. ..... 248/576; 248/160; 248/170; 40/602; 40/608

[58] Field of Search ..... 248/599, 160, 575, 619, 248/596, 597; 40/602, 606, 608, 612; 403/120

[56] References Cited

U.S. PATENT DOCUMENTS

| | | | |
|---|---|---|---|
| 623,008 | 4/1899 | Greb et al. | 248/597 X |
| 1,532,865 | 4/1925 | Beck . | |
| 1,750,118 | 3/1930 | Mueller et al. . | |
| 2,802,291 | 8/1957 | Bach et al. | 40/606 X |
| 3,646,696 | 3/1972 | Sarkisian . | |
| 3,662,482 | 5/1972 | Sarkisian . | |
| 3,899,843 | 8/1975 | Doyle et al. | 40/602 |
| 4,033,536 | 7/1977 | Hillstrom . | |
| 4,038,769 | 8/1977 | Werner | 40/612 X |
| 4,137,662 | 2/1979 | Baumer | 40/608 X |
| 4,309,836 | 1/1982 | Knapp . | |
| 4,365,435 | 12/1982 | Snyder | 40/608 |

FOREIGN PATENT DOCUMENTS

| | | |
|---|---|---|
| 1181967 | 6/1959 | France . |

*Primary Examiner*—Ramon S. Britts
*Assistant Examiner*—David M. Purol
*Attorney, Agent, or Firm*—Keil & Weinkauf

[57] ABSTRACT

An upright mast for a sign, and the like, is pivotally mounted upon a base and shaft with two adjustable resilient members, such as springs, mounted between the base and mast for separately resisting pivotal deflection in opposite directions.

16 Claims, 2 Drawing Sheets

DEFLECTABLE MOUNTING FOR UPRIGHT MAST

BACKGROUND OF THE INVENTION AND PRIOR ART

This invention relates to an improved mounting structure for a deflectable upright mast. More specifically, the invention relates to an improved structure for an outdoor sign or barrier which permits deflection, without damage, of the sign or barrier by wind forces and the like.

There is often need along vehicle roadways and pedestrian pathways for signs and barriers to provide information and mark off limits. Frequently the need is temporary and thus it is very advantageous to have mountings for such signs and barriers which may be readily assembled and disassembled; yet which will not be moved, disturbed, or overturned by wind and/or the weight of rain and snow, or by air currents generated by the movement of vehicles. Also to some extent it is advantageous that such signs and barriers be temporarily deflectable by a direct contact of vehicles and pedestrians and the like without permanent damage.

There have been a number of structures devised to permit signs and posters to be temporarily deflected by wind forces. One such prior structure is shown in French Pat. No. 1,181,967 wherein as essentially single mast signpost is supported on a pair of resilient and foldable base members. Two additional structures are shown in U.S. Pat. No. 3,662,482 where a poster board is supported on two upright members: in one embodiment the uprights are in turn supported on a torsion bar; and in the other embodiment a pair of flexible compression springs are substituted for the upright members. Also, U.S. Pat. No. 4,309,836 shows an adjustable flexible mast, for holding a sign, extending upwardly from a support frame.

However, the prior structures have involved resilient members which must be able to react in each of two opposite directions thereby tending to overwork the resilient members and increase the likelihood of loss through fatigue or overextension. Also, the prior structures do not provide for adjustment of the resilient members to allow compression against mild prevailing-wind forces or sloping terrain whereby themast and sign may be adjusted to be upright in the best visible posture. That is to say, the prior art devices will be deflected to some extent by any given wind force and therefore if there is a constant breeze, the sign will be constantly deflected with loss of some visibility.

OBJECTS AND SUMMARY OF THE INVENTION

Accordingly, it is an object of the present invention to provide an improved deflectable mounting for an upright mast for supporting a sign or barrier or the like wherein two separate resilient means are provided for resisting deflection of the mast in respective opposite directions.

It is another object of the present invention to provide an improved deflectable mounting for an upright mast for signs and barriers and the like, wherein there is an adjustment to maintain the mast vertical against a prevailing deflective force.

It is still another object of the present invention to provide an improved deflectablemounting for an upright mast for signs and barriers and the like, wherein two separate resilient members are provided to resist deflective forces in opposite directions and the resilient members are adjustably mounted so as to disengage through a portion of deflection in a direction opposite to that which each resilient member is intended to resist.

The present invention generally comprises a single mast intended for a vertical posture above a supporting base which mast is pivotally mounted upon the base and wherein two spring members are separately mounted between the mast and the base so that one spring resists pivoting of the mast principally in one direction and the other spring resists pivoting of the mast principally in a direction opposite thereto.

BRIEF DESCRIPTION OF THE DRAWINGS

Further objects and advantages will become apparent upon reading the following detailed specification in conjunction with the drawings, wherein.

DETAILED DESCRIPTION

Figure 1:
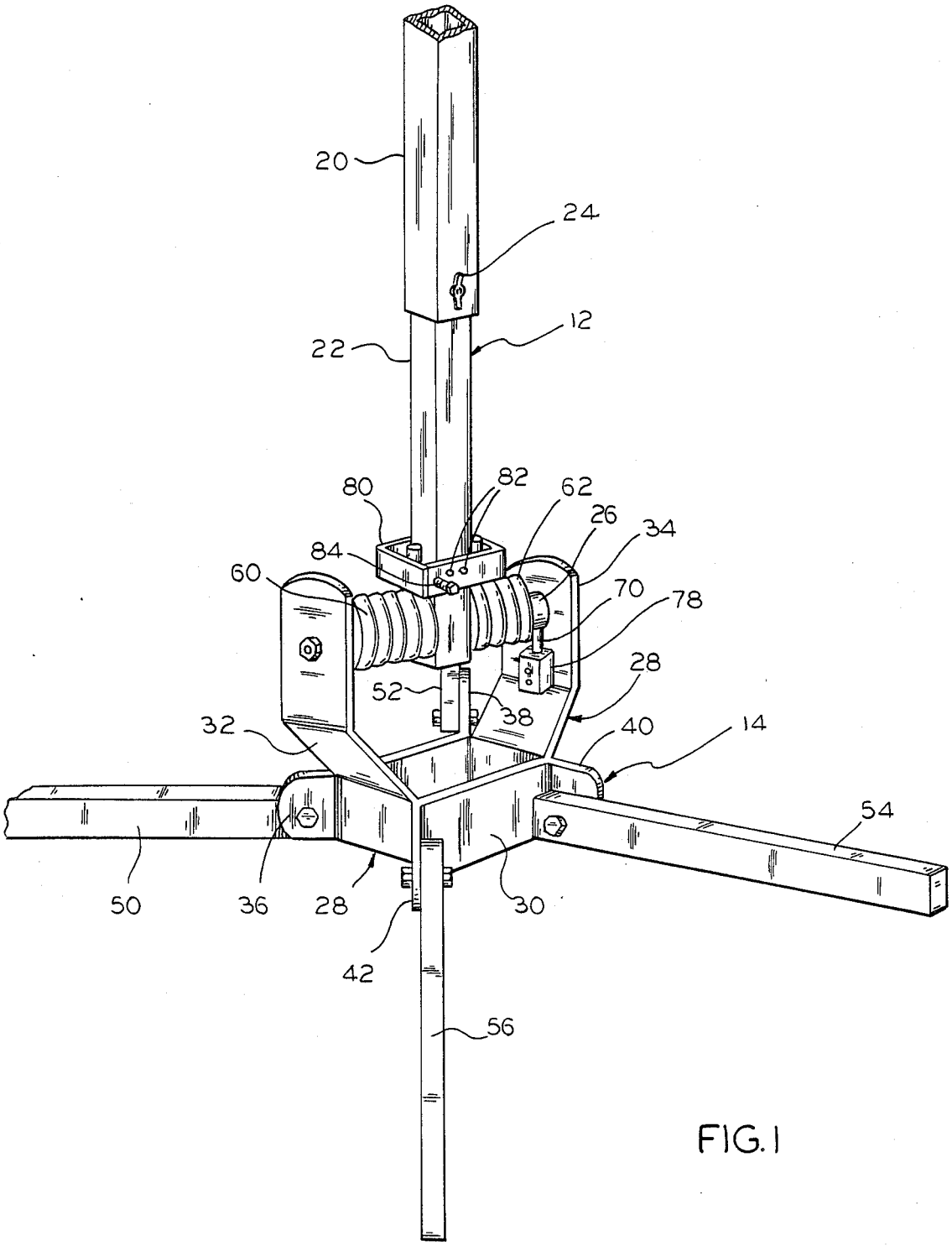
FIG. 1 is a perspective view of a preferred embodiment of the present invention.

The preferred embodiment of the invention shown in the figures comprises a visible member generally 10, such as a sign or barrier bar or the like, which is vertically supported upon a single mast generally 12, mounted upon a base, preferably a foldable base generally 14. It is desirable that the vertical height of the mast 12 be adjustable which can be accomplished by providing an upper mast portion 20 telescopically fitted to a lower mast portion 22 and a securing device 24, such as a set screw or the like, for releasably fastening the two portions 20,22 together.

According to the present invention, the lower portion of the mast 22 is connected to and mounted upon the base generally 14 by a pivotable means, preferably a horizontal shaft 26, journaled in the bottom of lower mast portion 22 and secured by bolts or the like at each end in a bifurcated mounting stand generally 28. Alternately the shaft 26 may be fixed to the mast 22, as by welding or the like, and the shaft mounted to be rotatable in mounting stand 28. It will be seen in the drawings that the mounting stand 28 comprises a lower frame 30 having two oppositely situated upright members 32,34 in the upper ends of which the shaft 26 is seated. The mounting stand 28 also has a multiple (preferably four) leg flanges 36,38,40 and 42 extending from the corners of the lower crosspiece 30; and an equal number of foldable and extendable legs 50,52,54 and 56 are pivotally mounted thereon.

Figure 2:
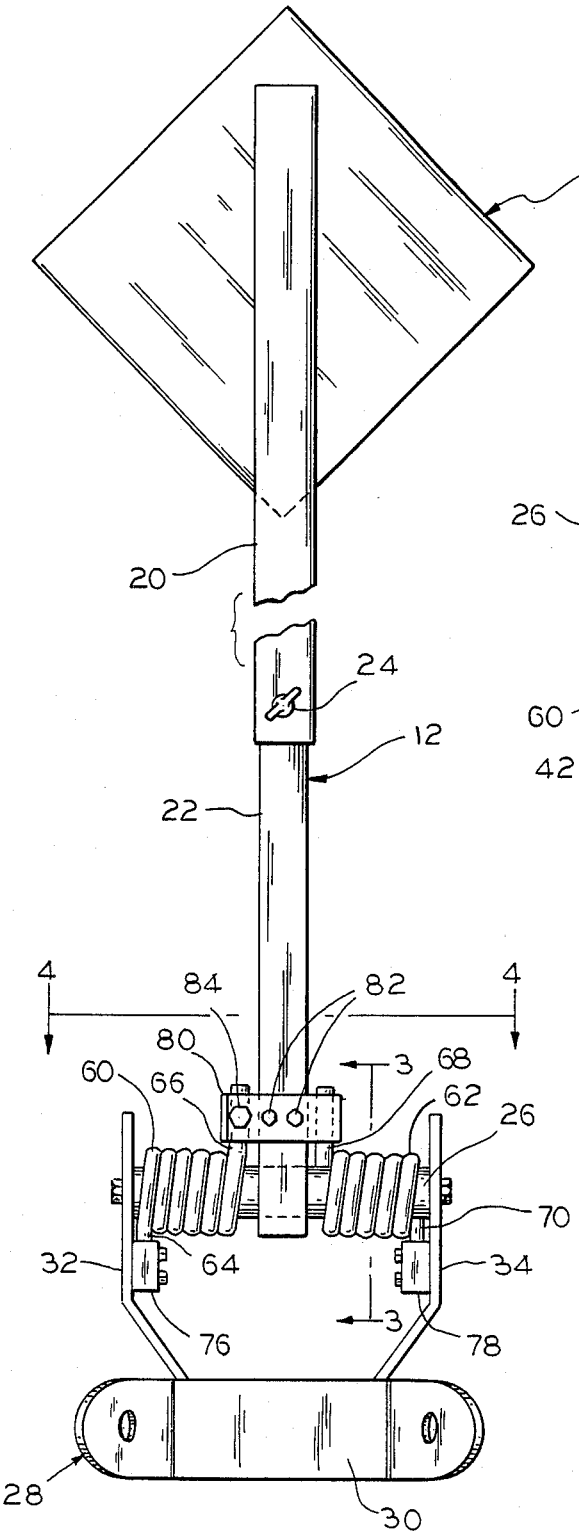
FIG. 2 is a front elevation of a portion of the apparatus shown in FIG. 1.

First and second resilient means are located between the lower mast portion 22 and the mounting stand 28 to urge the former in an upright position. These are preferably coil springs 60,62 (to the left and right as seen in FIG. 2) which are concentrically placed over the ends of the shaft 26 to either side of the mast 22. Coil springs 60,62 are substantially identical in dimensions, strength and direction of wind.

It is to be understood that the coil springs 60,62 of the preferred embodiment are of the type formed from elastic steel spring wire helically wound in cylindrical form and having outwardly extended radial ends for applying compression and tension forces to the helical coils. It is well known that in this type of spring tension forces, which tend to tighten the coils, are efficiently resisted by the spring and the ends will withstand a large degree of twist and tensioning movement without causing damage to the spring coils. However, these springs do not resist compressive forces, which tend to open the coils, efficiently and relatively small twisting movement of the ends in compression will cause permanent damage and loss of spring resiliency.

In the present invention the coil spring 60 has two opposite end strands 64,66 and coil spring 62 similarly has end strands 68,70. A holding bracket 76 on the upright member 32 of mounting stand 28 receives one end strand 64 of coil 60; and a similar holding bracket 78 on the upright 34 receives the end strand 70 of coil 62. These holding brackets 76,78 may be provided with set screws to securely fasten the spring end strands 64,70 in place. The respective opposite end strands 66,68 of springs 60,62 are loosely received at opposite ends of a rectangular mounting collar 80 that is secured about the lower mast 22 a short distance above the horizontal shaft 26. Preferably the mounting collar 80 is releasably secured to the mast 22 by mounting bolts 82, or the like, so that it may be loosened and raised for the assembly and disassembly of the springs 60,62. Also, the mounting collar 80 closely fits against the sides of the mast 22 parallel to the horizontal shaft 26 and extends over each side above the shaft 26 so as to leave openings wherein the respective end strands 66,68 may move in a plane perpendicular to the shaft. In this way the mast 22 may be pivoted several degrees on shaft 26 in a given direction before the respective end strand 66 or 68 becomes engaged by the mounting collar 80 in a compressive action to resist further deflection or pivoting; but at the same movement the other respective end strand 66 or 68 will be immediately engaged by the collar in a tension action to resist further deflection. Adjustment bolts 84,86 are preferably threaded through opposite sides of the mounting collar 80 in line with the respective end strands 66,68 whereby the degree of free pivoting deflection of the mast 22 may be adjusted and the spring end strand engaged.

Figure 4:
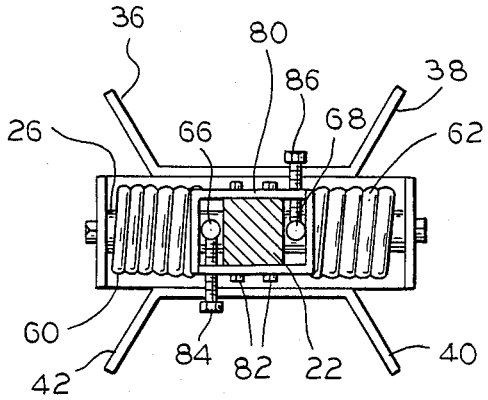
FIG. 4 is a partial plan view, in section, taken at line 4—4 in FIG. 2.
Figure 3:
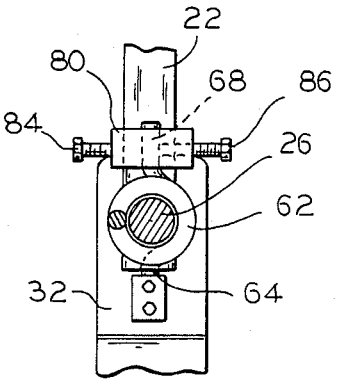
FIG. 3 is a partial end view of the apparatus taken at line 3—3 in FIG. 2.

As may be best seen in FIGS. 3 and 4, the spring end strands 66,68 normally extend upwardly in a near vertical direction when not under stress. Accordingly, by proper adjustment of each of the adjustment bolts 84,86 the mast 22 may be held vertical by the respective end strands 66,68 of the springs 60,62. However, by then tightening one and loosening the other of bolts 84,86 the mast 22 may be pivoted slightly on shaft 26 in either of two directions. Such adjustment may be made while still providing several degrees of play between the respective end strands 66,68 and the collar 80. Thus, when the mast 22 is adjusted either vertically or slightly to either side thereof, pressures applied against the mast 22 in one direction will be resisted immediately by the tension in one of the springs 60,62 and the other spring will not become compressed until the pressure has been sufficient to tension the first spring several additional degrees in pivoting movement. Reverse pressures in the opposite direction will result in the opposite of the springs 60,62 being tensioned immediately (after tension in the first spring is released) and several degrees pivoted movement may occur before the first spring is compressed.

In this way the mast 22 may be pre-adjusted to stand substantially vertical against a prevailing force, such as wind, which would otherwise constantly deflect the mast and any sign or visible display it carries.

While the preferred embodiment illustrated utilizes coil springs in the form of cylinders of helically wound wire, it would also be possible to utilize spiral wound springs comprising elastic steel wire wound in a single plane (similar to a watch spring).

It will be apparent to those skilled in the art that still further modifications and changes may be made without departing from the scope of the invention which is defined in the following claims.

What is claimed is:

1. An improved deflectable mounting for an upright mast, said mounting comprising:

a substantially vertical mast;

a base for supporting the mast;

pivotable means connecting the mast and base to enable the mast to be deflected in two opposite directions;

first resilient means mounted between said base and said mast for resisting deflection of said mast principally in one of said directions;

second resilient means mounted between said base and said mast for resisting deflection of said mast principally in the opposite of said direction; and adjustable mounting means for adjustably securing said first and second resilient means to one of said mast and base whereby to allow for biasing adjustment of the mast to a vertical position against a deflecting force and also provide a disconnection between each of said first and second resilient means during a portion of deflection in a direction opposite to the respective principal direction.

2. The apparatus of claim 1, wherein the pivotable means is a shaft extending substantially horizontally through the bottom of said mast and seated in said base.

3. The apparatus of claim 1, wherein both said first and second resilient means are wound springs mounted to be alternately tensioned by deflection of the said mast in said two opposite directions, respectively.

4. The apparatus of claim 2, wherein both said first and second resilient means are wound springs mounted to be alternately tensioned by deflection of the said mast in said two opposite directions, respectively.

5. The apparatus of claim 4, wherein said springs are helically wound and concentrically mounted on said shaft, a first spring being to one side of said mast and a second spring being to the opposite side of said mast.

6. The apparatus of claim 5, wherein the adjustable mounting means loosely receives an end of each spring whereby to permit a portion of deflection of said mast without compressing or tensioning each spring.

7. The apparatus of claim 6, wherein the adjustable means includes movable members to reduce or increase the amount of deflection by which the said springs will not be compressed or tensioned.

8. The apparatus of claim 6, wherein the adjustable means comprises a mounting collar secured to said mast above said shaft with openings left at both sides above said shaft, and each of said springs includes radially extending end strands which are received in said openings between said mounting collar and said mast.

9. The apparatus of claim 8, wherein adjustable bolts extend through said collar into said openings into contact with said end strands of said springs.

10. The apparatus of claim 9 having a short mast.

11. The apparatus of claim 10 having an upper mast attached to the short mast.

12. The apparatus of claim 11 having a panel attached to the upper mast.

13. An improved deflectable mounting for an upright mast, said mounting comprising:

a normally vertical mast member;

a base for supporting said mast member, said base having a plurality of foldable legs extendable therefrom to stabilize the base and mast member;

a normally horizontal shaft extending through a bottom of said mast and into said base whereby said mast member may be pivotably deflected in two opposite directions;

a mounting collar fastened to said mast member above said shaft, said collar having openings therein at the sides of said mast member above said shaft;

at least one bolt adjustable extending through said collar into said opening;

a first wound spring mounted about said shaft, one end of said spring being secured to said base and an opposite end of said spring extending into a collar opening at one side of said mast member; and a second wound spring mounted about said shaft, one end of said second spring being secured to said base and an opposite end of said second spring extending into a collar opening at an opposite side of said mast member whereby deflection of said mast member in one direction will tension said first spring and deflection of said mast member in an opposite direction will tension said second spring, and the said opposite ends of said springs received within the said collar openings will be alternately disengaged for a portion of mast member deflection when the tension is released and before each respective spring is compressed.

14. The apparatus of claim 13 having a shot mast.

15. The apparatus of claim 14 having an upper mast attached to the short mast.

16. The apparatus of claim 15 having a panel attached to the upper mast.

* * * * *